United States Patent [19]

Campau

[11] Patent Number: 4,484,601

[45] Date of Patent: Nov. 27, 1984

[54] LIQUID LEVEL CONTROL DEVICE

[76] Inventor: Daniel N. Campau, 656 Duxbury Ct., SE., Grand Rapids, Mich. 49506

[21] Appl. No.: 404,070

[22] Filed: Aug. 2, 1982

[51] Int. Cl.[3] ..... F15C 1/10

[52] U.S. Cl. ..... 137/805; 137/841; 137/393; 137/804

[58] Field of Search ..... 137/386, 804, 805, 841, 137/393

[56] References Cited

U.S. PATENT DOCUMENTS

| | | | |
|---|---|---|---|
| Re. 29,715 | 8/1978 | Richards et al. | 141/226 |
| 3,277,914 | 10/1966 | Manion | 137/805 |
| 3,581,754 | 6/1971 | Adams | 137/805 |
| 3,586,073 | 6/1971 | West | 137/386 |
| 3,703,907 | 11/1972 | Richards | 137/386 |
| 4,148,334 | 4/1979 | Richards | 137/389 |
| 4,211,249 | 7/1980 | Richards | 137/393 |

FOREIGN PATENT DOCUMENTS

| | | | |
|---|---|---|---|
| 42-34132 | 12/1967 | Japan | 137/386 |

*Primary Examiner*—A. Michael Chambers
*Attorney, Agent, or Firm*—Niro, Jager & Scavone

[57] ABSTRACT

A liquid level control device for controlling the flow of liquid into a reservoir, storage tank or the like, incorporating automatic shut-off characteristics. The device includes nozzle means including a fluid amplifier for automatically closing valve means in response to sensing means disposed remote from the nozzle means and fluid amplifier. The remote sensing means is responsive to the static presence of the interface at a sensing level of liquid in the reservoir.

16 Claims, 7 Drawing Figures

LIQUID LEVEL CONTROL DEVICE

Background Of The Invention

The present invention relates generally to liquid level control devices and, in particular, to devices which may be utilized as nozzles to control the flow of liquid into a reservoir, storage tank or the like. The device of the present invention is particularly useful in an application where automatic shut-off features are desirable.

In U.S. Pat. No. 3,703,907, a fluid amplifier is disclosed having an inlet and an outlet zone and adapted for use in a liquid reservoir to sense a change of liquid level therein. The amplifier is adapted to be positioned adjacent the desired liquid sensing level in the reservoir and adapted for directing a substantially laminar power stream substantially transversely to the surface of the liquid in the reservoir. Inlet means is constructed and arranged such that a fluid power jet is abruptly altered to a substantially turbulent flow pattern when the liquid level in the reservoir rises to a sensing level. This abrupt alteration develops a fluid pressure signal which may be used to control various apparatus.

For instance, U.S. Pat. No. 4,211,249 discloses a fluid amplifier as described above in a liquid level control system for maintaining the reservoir at or near a predetermined liquid maintenance level, such as in swimming pools or the like.

Fluid amplifiers of the character described also have been used in automatic shut-off nozzles as disclosed in U.S. Pat. No. Re. 29,715 wherein a nozzle is shown particularly useful in an application such as self-service gasoline retail outlets.

There is a need for and it would be desirable to provide a liquid level control device incorporating automatic shut-off characteristics for controlling the flow of liquid into a reservoir such as a swimming pool, storage tank or the like, wherein the sensing level of liquid in the reservoir is at a remote point from the fluid amplifier itself. The present invention is directed, in part, to satisfying such a need.

Summary Of The Invention

An object, therefore, of the present invention is to provide a liquid level control device for controlling the flow of liquid into a reservoir, storage tank or the like, including automatic shut-off characteristics, and wherein the device can be located remote from the actual sensing level of liquid in the reservoir.

In the exemplary embodiment of the invention, the liquid level control device includes nozzle means having a liquid passage therethrough for developing a substantially laminar liquid power stream. The nozzle includes valve means in the liquid passage for opening and closing the passage, along with manually operable valve opening means. Fluid amplifier means is disposed in the liquid power stream and is operatively associated with the valve means for generating a positive fluid pressure to maintain the valve means open in the presence of the laminar stream. The fluid amplifier includes an access region to the liquid power stream between an inlet and outlet of the amplifier. Sensing means in provided remote from the nozzle and in communication with the access region. The sensing means is responsive to the static presence of the interface at a sensing level of liquid in the reservoir to communicate liquid to the access region for physically contacting the substantially laminar power stream to alter the laminar stream to a substantially turbulent flow pattern. This alteration disrupts the pressure generating ability of the fluid amplifier and thereby closes the valve means in response to the remote sensing of a level of liquid in the reservoir.

The sensing means comprises conduit means, such as an open ended tube, in communication and leading from the access region to a desired remote point for sensing a level of liquid in the reservoir.

In the preferred embodiment the fluid amplifier means includes inlet means for developing the substantially laminar power stream and outlet means spaced from the inlet means. Restricting means is provided for restricting flow of liquid at the outlet to create a negative pressure in the access region to draw liquid through the sensing means from the interface at the sensing level of liquid in the reservoir. The restricting means herein comprises a fitting defining a restrictive orifice at the outlet for the passage of the power stream therethrough.

By using the restricting means for creating a negative pressure in the access region of the fluid amplifier, the sensing means can extend away from the amplifier to a remote point for sensing the level of liquid in the reservoir and still draw sufficient liquid from the interface at the sensing level to affect the fluid amplifier which automatically shuts off the flow of liquid to the reservoir.

The device of the present invention, although shown herein for use in filling swimming pools or similar reservoirs, is equally applicable for a wide range of applications such as farm applications in filling livestock tanks as well as in industrial applications for filling chemical tanks where it would be desirous to isolate the chemical level sensing area and the fumes created thereby from the actual actuating components of the device and its operator.

Other objects, features and advantages of the invention will be apparent from the following detailed description taken in connection with the accompanying drawings.

Description Of The Drawings

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

Detailed Description Of The Invention

Figure 1:
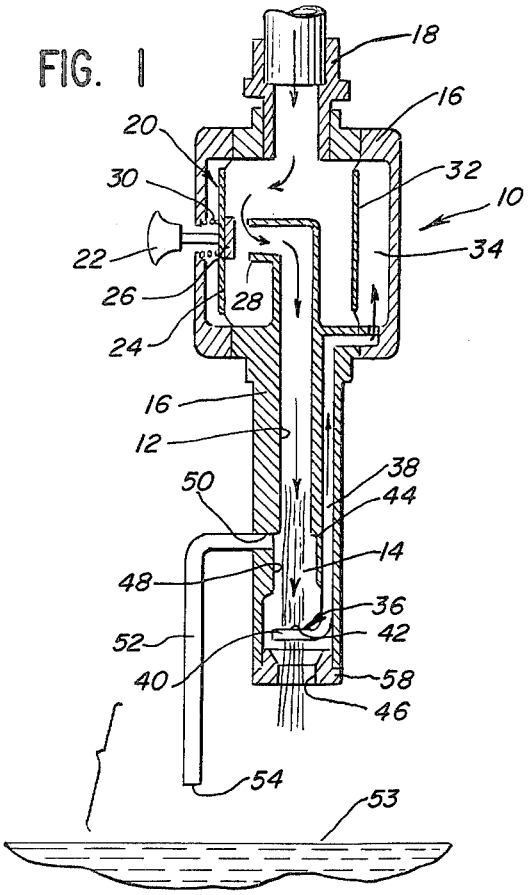
FIG. 1 is a central sectional view through a liquid level control device in the form of an automatic shut-off nozzle incorporating the remote sensing means of the present invention, with a laminar power stream passing through the device.

Referring to the drawings in greater detail, and first to FIG. 1, a liquid level control device, generally designated 10, is illustrated for controlling the flow of liquid into a reservoir such as a swimming pool, storage tank or the like. The device is illustrated as nozzle means including a liquid passage 12 therethrough for developing a substantially laminar liquid power stream indicated by the arrow 14. The device includes a housing 16 having a coupling 18 for attachment to a supply hose, such as a common garden hose.

Valve means, generally designated 20, is provided in liquid passage 12 for opening and closing the passage. The valve means includes a manually operable valve opening means having a knob or handle 22 secured to a diaphragm 24. Diaphragm 24 is integral with a valve closure member 26 which engages a valve seat 28 defining an entrance to liquid passage 12. A coil spring 30 is sandwiched between housing 16 and the valve closure member to bias the closure member against valve seat 28. Valve means 20 includes a second diaphragm 32 in housing 16 and separates the fluid input portion of housing 16 from a positive pressure diaphragm chamber 34. The valve closure member 26 and diaphragm 24 are connected to the second diaphragm 32 by means described hereinafter.

Fluid amplifier means, generally designated 36, is disposed in liquid power stream 14 for generating a positive fluid pressure to diaphragm chamber 34 to maintain the valve means open in the presence of a laminar liquid power stream. More particularly, fluid amplifier 36 includes a conduit 38 communicating with the positive pressure diaphragm chamber 34. Conduit 38 has a portion 40 extending transversely across and into the laminar liquid power stream 14. Conduit portion 40 has a port 42 exposed to the power stream for generating a positive fluid pressure signal, through the conduit, and to diaphragm chamber 34.

Fluid amplifier means 36 has an inlet 44, an outlet 46 and an access region 48. It can be seen that access region 48 is of a slightly larger cross section than inlet 44 so that the laminar liquid power stream freely flows from inlet 44 to port 42.

It will be understood that as long as a laminar liquid power stream flows through amplifier 36, a pressure signal is generated into diaphragm chamber 34 to hold valve closure member 26 open after initial manual opening by pulling on knob 22. This is true because the pressure on diaphragm 34 is greater than the biasing force of compression coil spring 30.

The present invention contemplates sensing means remote from nozzle 10 and amplifier 38, in communication with access region 48, for sensing the level of liquid in a reservoir, storage tank or the like. More particularly, an access port 50 extends through the housing transversely of access region 48. Conduit means in the form of an open ended tube 52 is in communication with and leads away from the access region to a desired point for sensing a level of liquid in the reservoir. It should be noted that although tube 52 is shown of a relatively short length in FIG. 1, longer lengths are contemplated. For instance, a liquid lever 53 is shown below the sensing opening 54 of tube 52 to indicate a "low level" in the reservoir.

Figure 2:
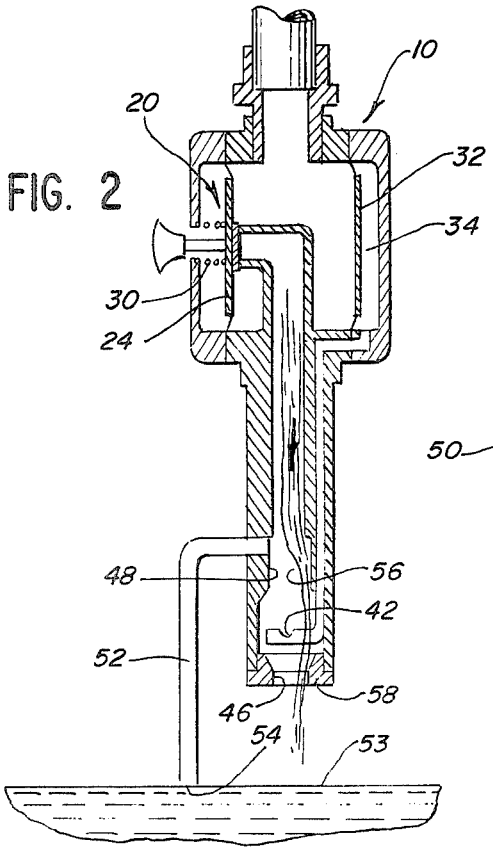
FIG. 2 is a view similar to that of FIG. 1, with a liquid level being sensed and the laminar power stream altered.

Referring to FIG. 2, sensing tube 52 is responsive to the static presence of the interface at a sensing level of liquid in the reservoir to communicate liquid to access region 48 for physically contacting the substantially laminar power stream to alter the laminar stream to a substantially turbulent flow pattern. More particularly, it can be seen in FIG. 2 that the interface at the liquid level 53 has reached the sensing opening 54 of sensing tube 52. At this point, liquid is drawn through the tube into access region 48 whereby the liquid physically contacts the laminar power stream to effect a substantially turbulent flow pattern as indicated at 56. The entering liquid from the reservoir may, in fact, divert the power stream, as shown, away from fluid amplifier port 42. When this occurs, the pressure signal to positive pressure diaphragm chamber 34 is reduced and compression coil spring 30 causes the valve means 20 to close and shut-off the supply of liquid.

In other words, alteration of the laminar liquid power stream disrupts the pressure generating ability of the fluid amplifier and thereby closes the valve means in response to the remote sensing of a level of liquid in the reservoir.

In order to positively effect drawing of liquid from the reservoir at the sensed interface level 53 thereof through sensing tube 52, restricting means 58 is provided for restricting flow of liquid at the outlet 46. This restriction creates a negative pressure in access region 48 and, in effect, sucks liquid through sensing tube 52 and into physical contact with the power stream to disrupt the stream.

Figure 3:
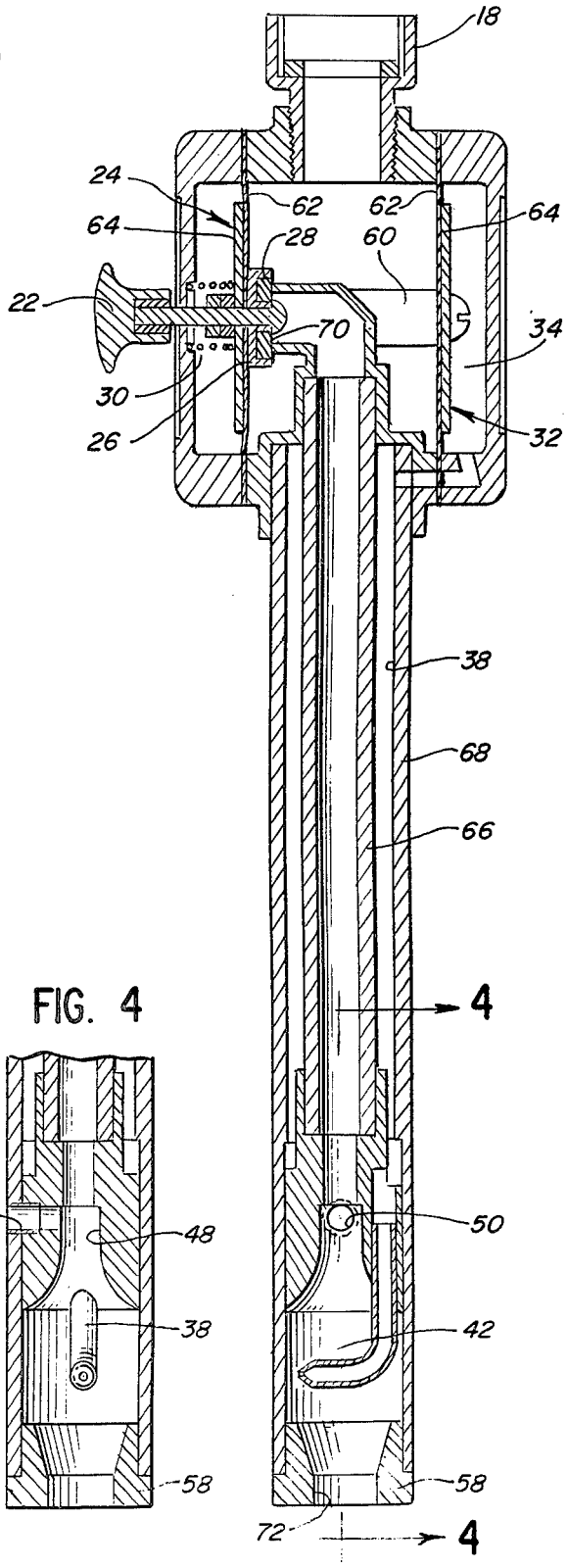
FIG. 3 is a detailed longitudinal sectional view of the device of the present invention.

FIG. 3 is a detailed sectional view of the device of the present invention described functionally in relation to FIGS. 1 and 2. It can be seen that coupling 18 can comprise a standard screw connection for a typical garden hose. The means for interconnecting diaphragms 24, 32 comprise one or more connecting rods 60 whereby the diaphragms are operatively associated for conjoint movement. The diaphragms include flexible wafers 62 secured about their edges on the inside of more rigid washers 64 secured to the connecting rods 60. The laminar liquid power stream is formed by a central tube 66 within an outer tube 68, with conduit means 38 between the tubes. The conduit means communicates between fluid amplifier port 42 and positive pressure diaphragm chamber 34. Valve closure member 26 includes a resilient cushion insert 70 for engaging valve seat 28. Lastly, restricting means 58 comprises a nozzle tip which is press-fit to define a restrictive orifice 72 at the outlet of the fluid amplifier.

Figure 4:
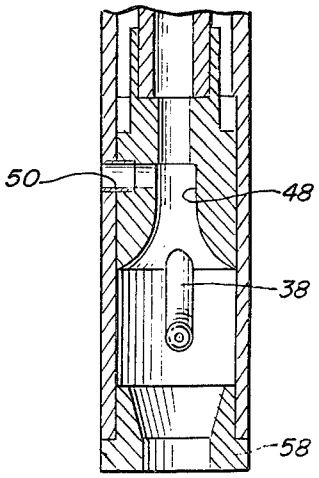
FIG. 4 is a fragmented sectional view of the access means at the inlet of the fluid amplifier.

FIG. 4 is a fragmentary view illustrating the transverse disposition of access port 50 relative to access region 48.

Figure 5:
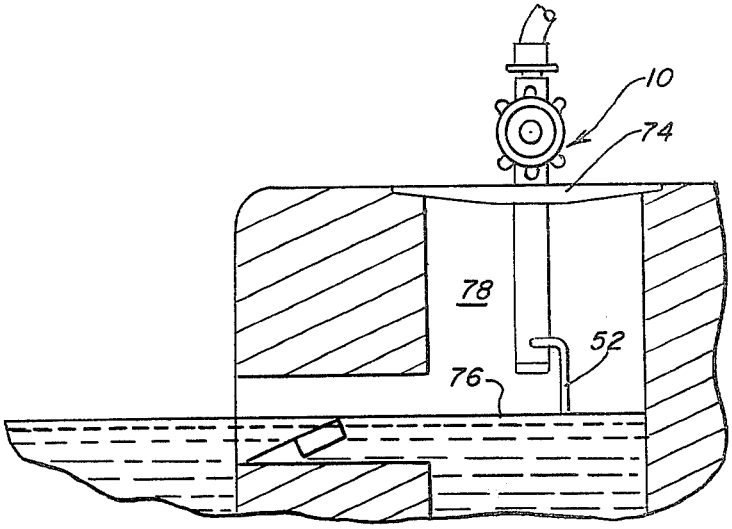
FIG. 5 is a somewhat schematic view of the device of the present invention located in the skimmer coverplate of an in-ground swimming pool.
Figure 6:
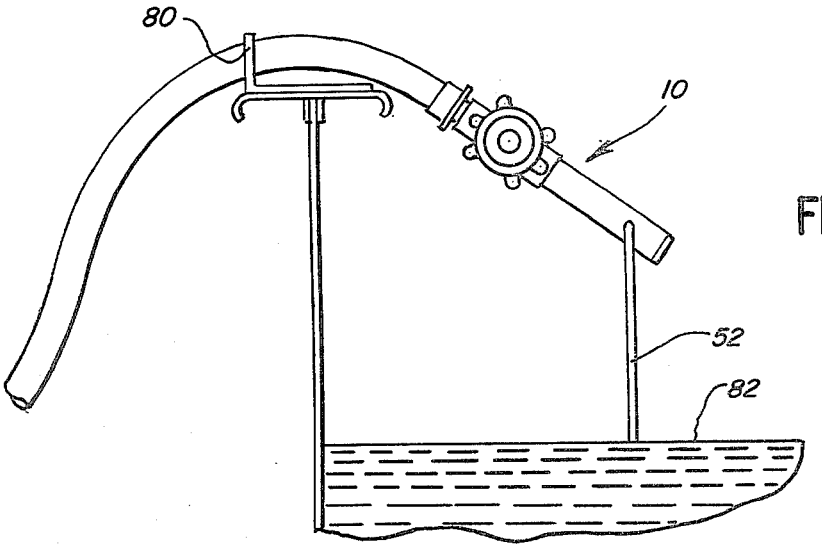
FIG. 6 is a somewhat schematic view of the device of the present invention located on a bracket along the edge of a swimming pool.

FIGS. 5 and 6 illustrate exemplary applications of the device of the present invention as used for filling swimming pools. In FIG. 5, the device is mounted in the skimmer coverplate 74 along the edge of an in-ground swimming pool. It can be seen that sensing tube 52 extends downwardly to a remote position to sense the static presence of the interface at a sensing level 76 of liquid in the skimmer channel 78 of the pool. FIG. 6 shows the device mounted on a bracket 80 alongside an above-ground swimming pool, with the sensing tube 52 again extending downwardly to a remote level 82 of the liquid in the pool. Both FIGS. 5 and 6 illustrate that the device itself need not project into the water in the pool and, of course, sensing tube 52 may be longer than as shown. The negative pressure created by restricting means 58 (FIGS. 1–3) creates a negative pressure in access region 48 to draw liquid upwardly into the fluid amplifier sufficient to disrupt the laminar liquid power stream therethrough.

Figure 7:
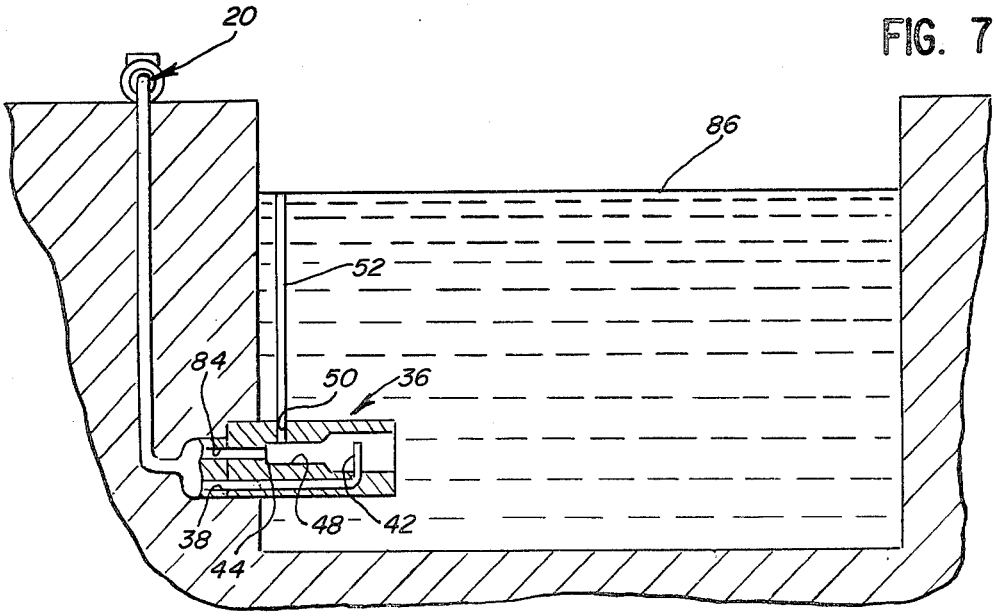
FIG. 7 is a somewhat schematic view of the device of the present invention located in a below-ground filling system for a swimming pool.

Referring to FIG. 7, a somewhat schematic illustration of the use of the device of the present invention is illustrated as incorporated in a below-ground filling system for a swimming pool. In this illustration, valve means 20 is disposed above ground for manual opening of the valve. A water supply conduit 84 extends from the valve downwardly to fluid amplifier 36. Positive pressure conduit 38 extends upwardly from the fluid amplifier back to valve 20 to automatically shut-off the valve as described above. Like numerals are used to designate like components of the fluid amplifier, such as access region 48. In this application of the invention, sensing tube 52 extends upwardly to sense the static presence of the interface at a sensing level 86 of the water in the pool. Since the fluid amplifier is located below the sensing level, the water head above the amplifier is sufficient to effect flow of water downwardly through tube 52 sufficient to disrupt the laminar power stream in the amplifier. Consequently, the restricting means 58 described above in relation to the above-ground filling applications is not necessary.

Thus, it can be seen that a new and improved liquid level control device has been provided for controlling the flow of liquid into a reservoir such as a swimming pool, storage tank or the like, wherein automatic shut-off characteristics are important, while providing sensing means for the fluid amplifier at a point remote from the amplifier itself. The restricting means 58 creates sufficient negative pressure in access region 48 to effect drawing of disrupting liquid through sensing tube 52 into physical contact with the normally substantially laminar power stream through the device and fluid amplifier. Although the device is shown herein as incorporated in swimming pool applications, it is to be understood that a wide range of applications are contemplated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A liquid level control device for controlling the flow of liquid into a reservoir, storage tank or the like, comprising:

nozzle means including fluid amplifier means having inlet means for developing a substantially laminar liquid power stream, outlet means spaced from said inlet means, signal port means exposed to said liquid power stream for generating a positive fluid pressure to appropriate control means supplying liquid in the presence of said laminar stream, and an access region to said liquid power stream;

sensing means remote from said nozzle means and in communication with said access region, said sensing means being responsive to the static presence of the interface at a sensing level of liquid in said reservoir to communicate liquid to said access region for physically contacting said substantially laminar power stream to alter said laminar stream to a substantially turbulent flow pattern which disrupts the pressure generating ability of said fluid amplifier means and thereby stops the supply of liquid in response to the remote sensing of a level of liquid in said reservoir; and restricting means for restricting flow of liquid at said outlet means to create a negative pressure in said access region to draw liquid through said sensing means from the interface at the sensing level of liquid in said reservoir.

2. The liquid level control device of claim 1 wherein said sensing means comprises conduit means in communication with and leading from said access region to a desired point for sensing a level of liquid in said reservoir.

3. The liquid level control device of claim 2 wherein said conduit means comprises an open ended tube.

4. The liquid level control device of claim 1 wherein said restricting means includes a restrictive orifice at said outlet means for the passage of said power stream therethrough.

5. The liquid level control device of claim 1 wherein said sensing means comprises conduit means in communication with and leading from said access region to a desired point for sensing a level of liquid in said reservoir.

6. The liquid level control device of claim 5 wherein said conduit means comprises an open ended tube.

7. The liquid level control device of claim 1 wherein said fluid amplifier means is located below the surface of liquid in said reservoir, and said sensing means extends upwardly therefrom to a desired sensing level of liquid in the reservoir.

8. The liquid level control device of claim 7 wherein said sensing means comprises conduit means in communication with and leading from said access region to a desired point for sensing a level of liquid in said reservoir.

9. A liquid level control device for controlling the flow of liquid into a reservoir, storage tank or the like, comprising:

nozzle means including a liquid passage therethrough for developing a substantially laminar liquid power stream, valve means in said liquid passage for opening and closing said passage, valve opening means, and fluid amplifier means in said liquid power stream and operatively associated with said valve means for generating a positive fluid pressure to maintain said valve means open in the presence of said laminar stream, said fluid amplifier means including an access region to said liquid power stream and means for creating a negative pressure in said access region; and sensing means remote from said nozzle means and in communication with said access region, said sensing means being responsive to the static presence of the interface at a sensing level of liquid in said reservoir to draw liquid to said access region under the influence of said negative pressure for physically contacting said substantially laminar power stream to alter said laminar stream to a substantially turbulent flow pattern which disrupts the pressure generating ability of said fluid amplifier means and thereby closes said valve means in response to the remote sensing of a level of liquid in said reservoir.

10. The liquid level control device of claim 9 wherein said sensing means comprises conduit means in communication with and leading from said access region to a desired point for sensing a level of liquid in said reservoir.

11. The liquid level control device of claim 10 wherein said conduit means comprises an open ended tube.

12. The liquid level control device of claim 9 wherein said means for creating a negative pressure in said access region comprises restricting means for restricting flow of liquid at an outlet of said fluid amplifier.

13. The liquid level control device of claim 12 wherein said restricting means includes a restrictive orifice at an outlet of said fluid amplifier means.

14. A liquid level control device for controlling the flow of liquid into a reservoir, storage tank or the like, comprising:

nozzle means including fluid amplifier means having inlet means for developing a substantially laminar liquid power stream, outlet means spaced from said inlet means, means exposed to said liquid power stream for generating a positive fluid pressure to control the supply of liquid, an access region to said liquid power stream, and means for creating a negative pressure in said access region; and sensing means remote from said nozzle means and in communication with said access region, said sensing means being responsive to the static presence of the interface at a sensing level of liquid in said reservoir to draw liquid to said access region under the influence of said negative pressure for physically contacting said substantially laminar power stream to alter said laminar stream to a substantially turbulent flow pattern which disrupts the pressure generating ability of said fluid amplifier means and thereby closes said valve means in response to the remote sensing of a level of liquid in said reservoir.

15. The liquid level control device of claim 14 wherein said means for creating a negative pressure in said access region comprises restricting means for restricting flow of liquid at an outlet of said fluid amplifier means.

16. The liquid level control device of claim 15 wherein said restricting means includes a restrictive orifice at an outlet of said fluid amplifier means.

* * * * *